United States Patent [19]

McClellan

[11] 4,332,350

[45] Jun. 1, 1982

[54] CENTRIFUGE APPARATUS FOR SEPARATING ENTRAINED SOLIDS FROM INDUSTRIAL WASTE WATER

[76] Inventor: Jack A. McClellan, 15285 Charmeran Ave., San Jose, Calif. 95124

[21] Appl. No.: 173,736

[22] Filed: Jul. 30, 1980

[51] Int. Cl.[3] ..... B04B 11/081; B04B 1/00

[52] U.S. Cl. ..... 233/7; 233/22; 233/28

[58] Field of Search ..... 233/7, 19 R, 16, 19 A, 233/21, 22, 46, 47, 28, 3, 27; 415/88, 89; 210/360.1, 256

[56] References Cited

U.S. PATENT DOCUMENTS

| | | | |
|---|---|---|---|
| 2,318,293 | 5/1943 | Cornell | 366/135 |
| 2,712,897 | 7/1955 | Kusserow | 233/28 |
| 3,213,592 | 10/1965 | Rich | 233/27 |
| 3,994,618 | 11/1976 | Erickson | 233/27 |

*Primary Examiner*—Robert W. Jenkins
*Attorney, Agent, or Firm*—John J. Leavitt

[57] ABSTRACT

Presented is a centrifuge apparatus for separating a high percentage of entrained solids from industrial waste water. The apparatus utilizes centrifugal force to separate materials according to their densities, and a novel scoop arrangement for scooping up the separated high density solid materials and ejecting them from the apparatus.

16 Claims, 6 Drawing Figures

CENTRIFUGE APPARATUS FOR SEPARATING ENTRAINED SOLIDS FROM INDUSTRIAL WASTE WATER

BACKGROUND OF THE INVENTION

1. Field of the Invention

This invention relates to the separation of entrained solids from industrial waste water, and particularly to an apparatus which operates on the principle of a centrifuge, i.e., the use of centrifugal force to separate materials of different density, accompanied by means for segregating a high percentage of the solid material from the liquid phase in which they were previously entrained.

2. Description of the Prior Art

The prior art relating to the subject matter of this invention is believed found in Class 210, sub-classes 76, 78, 82, 256, 408, 297, 360, 390, 394 and 396. A search conducted in the class and classes noted has revealed the existence of the following U.S. Pat. Nos.: 790,081; 978,238; 2,113,321; 1,262,146; 2,657,803; and 3,797,662.

The concept of utilizing centrifugal force to effect the separation of materials having different densities has long been known and has been used in many different fields, including the medical field where many different types of equipment are utilized which operate on the principle that centrifugal force properly applied in a suitable apparatus will effect a separation of materials having different densities or different specific gravities. Thus, blood plasma is separated from whole blood in this manner. In the dairy industry, centrifugal force has been used as the basic principle for separating high density cream from raw milk. There is even available for use in the kitchen a spin dryer which operates similar to the spin cycle of an automatic washing machine in which a rapidly rotating drum causes centrifugal force to drive moisture from lettuce or other leafy vegetables contained in the rapidly rotating basket. Accordingly, no claim is made to the concept of utilizing centrifugal force to effect a separation of materials having different specific gravities or densities. Rather, what is presented herewith and what is sought to be protected by letters patent of the United States constitutes a novel structure which in tests appears to be highly efficient for separating entrained solids from industrial waste water.

In the food processing industry, such as canneries and packing plants, the discharge of waste water into the sanitary sewer system in most cities is monitored by the taxing authorities, and a tax is imposed in proportion to the number of gallons of water discharged into the sanitary sewer system, regardless of whether that waste water contains solids. In addition to the charge imposed for "clean" waste water, an additional charge is imposed that is proportional to the "solids" that are entrained in the stream of waste water. Obviously, it is much more difficult for the sanitary sewer system to handle waste water that carries a high proportion of solids.

The determination of how much to charge for the discharge of waste water, whether it be "clean" or loaded with "solids" is determined by periodic sampling of the waste water stream just prior to its discharge into the sanitary sewer system. From such samples, the volume of water and the volume of "solids" entrained therein are computed. It is not unusual for a food processing cannery or a packing plant to be charged a flat fee of say $35,000.00 per year for the hook-up to the sanitary sewer system, and to be charged an additional $35.000.00 per year computed from the volume of water and the volume of waste "solids" entrained in such water discharged into the sanitary sewer system. Thus, a burden of $70,000.00 per year is imposed on the food processing plant, which must of course be passed on to the ultimate consumer in the form of higher prices for the commodity being processed or packed. Accordingly, it is one of the important objects of the present invention to provide an apparatus that effectively separates from 75% to 95% of the entrained "solids" from the stream of waste water, thus providing a basis for reducing the amount of service charge that is imposed on the facility, with the result that such saving can be passed on to the ultimate consumer in the form of lower prices.

In most canneries and packing plants, a preliminary separation is effected through appropriate screens or sieves through which waste water is passed in an effort to collect as much of the larger particles of "solids" as is possible to prevent such "solids" from entering into the sanitary sewer system. It is not intended that the apparatus forming the subject matter of this invention replace such preliminary screening methods or devices. Rather, it is intended that the apparatus forming the subject matter of this invention be installed downstream from any such devices, and that it be effective in separating and collecting the types of solids that are entrained in the waste water stream that would require too fine a screen for separation purposes, thus imposing a back pressure on the waste water stream that cannot be accommodated, or which would clog the screen, requiring periodic shut-down of the plant to effect cleaning of such screens. Accordingly, another object of the present invention is the provision of a waste water centrifuge apparatus that may be operated on a continuous basis, which may have all of the waste water stream diverted through the centrifuge apparatus to effect a high percentage of separation of entrained solids from such waste water, or which may be incorporated in series with other like centrifuge apparatuses to minimize the entrained solids, or connected in parallel with similar centrifuge apparatuses to increase the volumetric capacity that can be handled at any given time.

Another object of the invention is the provision of a centrifuge separating apparatus for industrial waste waters that may be operated by either an internal combustion engine or an electric motor.

A still further object of the invention is the provision of a centrifuge apparatus for separating solids from industrial waste water which incorporates inner and outer housings that may be rotated at different speeds so as to control the efficiency of extraction of solids from the waste water stream.

A still further object of the invention is the provision of a centrifuge apparatus for separating solids from industrial waste water and which incorporates inner and outer housings operating at the same rotational speed, and a "solids" pickup device within the outer housing that rotates at a controllably different speed.

Still another object of the invention is the provision of a centrifuge apparatus for industrial waste water that converts a stream of industrial waste water from a high velocity stream at the input end of the apparatus to a relatively lower velocity stream at the output end thereof.

Still another object of the invention is the provision of a centrifuge apparatus for separating solids from industrial waste water in which two conically configured coaxially arranged internal and external shells are provided, including baffles extending therebetween and defining a high velocity zone associated with the input end of the industrial waste water and a low velocity or "quiet" zone associated with the separation of solids from the stream of waste water, and means within the low velocity or quiet zone for extracting separated solids from inside the housing and depositing such solids outside thereof.

The invention possesses other objects and features of advantage, some of which, with the foregoing, will be apparent from the following description and the drawings. It is to be understood however, that the invention is not limited to the embodiments illustrated and described, since it may be embodied in various forms within the scope of the appended claims.

SUMMARY OF THE INVENTION

In terms of broad inclusion, the centrifuge apparatus of the invention is particularly useful for separating entrained solids from a stream of industrial waste water such as is produced in canned food processing plants such as canneries, fresh food packing plants, and frozen food processing plants. In one aspect, the invention comprises coaxially arranged rotatable inner and outer housings adapted to rotate at controlled and different rotational speeds, with the inlet water admitted to one end of the housing, means within the housing intermediate the ends thereof for collecting solids in a solids-collection zone and means associated with the collection means for picking up and transporting the collected solids out of the housing, while the treated waste water is discharged from the opposite end of the housing.

In another aspect of the invention, inner and outer housings are provided that rotate at a similar rotational speed, with industrial waste water having entrained solids being admitted to one end of the housing in what may be categorized a high velocity zone, the waste water progressing through the housing between inner and outer shells that increase in diameter downstream so as to increase the volumetric capacity of the housing and thereby reduce the velocity of the waste water with maximum velocity reduction occurring at a separation zone which may be categorized a "quiet" zone within the housing, and means within the separation zone for picking up and transporting the separated solids from the interior of the housing to the outside thereof. Means are also provided for controlling the speed of rotation of either the inner or outer or both of the housings and controlling the speed of rotation of the pick-up device.

DESCRIPTION OF THE PREFERRED EMBODIMENT

Figure 1:
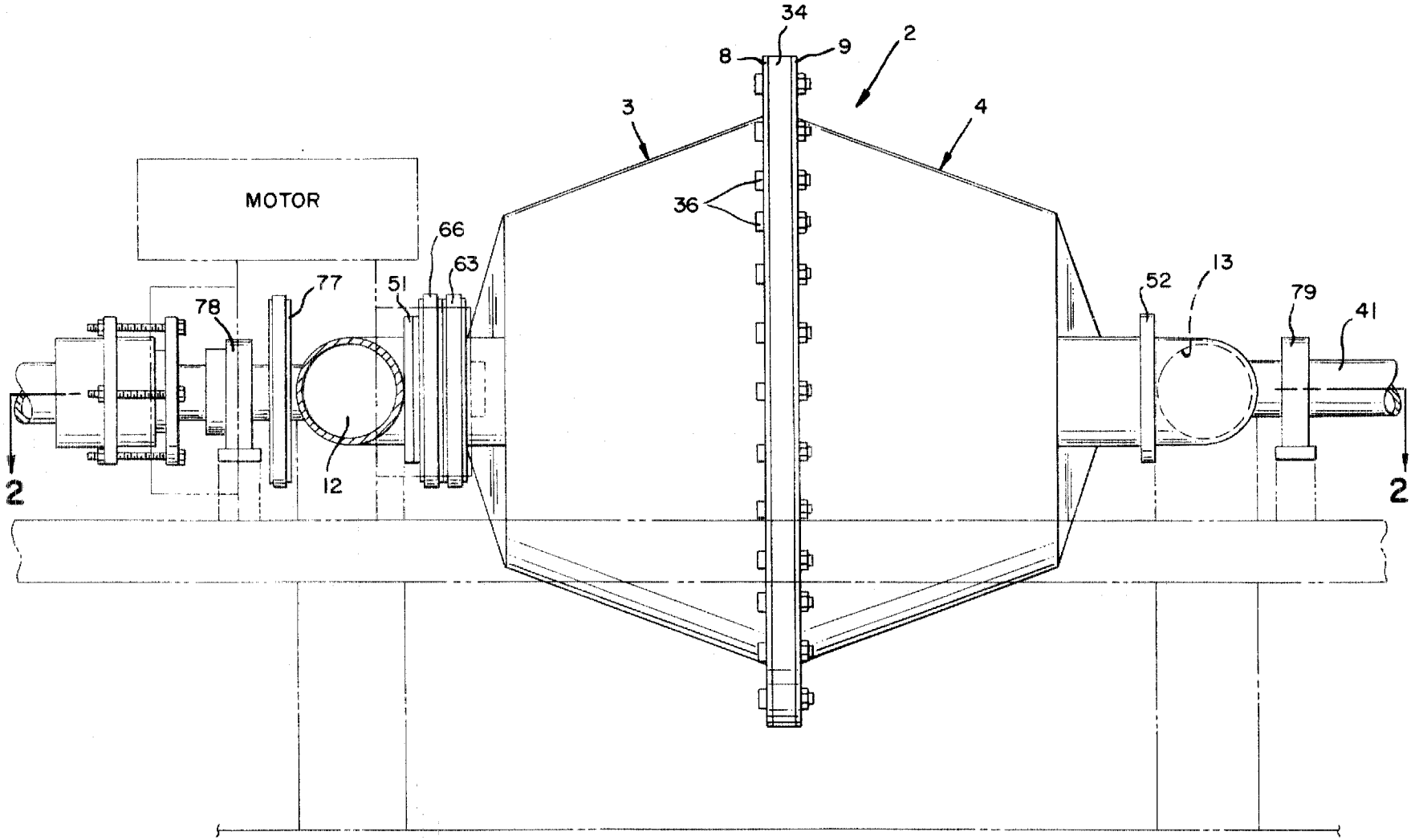
FIG. 1 is a side elevational view of the apparatus shown mounted for rotation about a horizontal axis.
Figure 2:
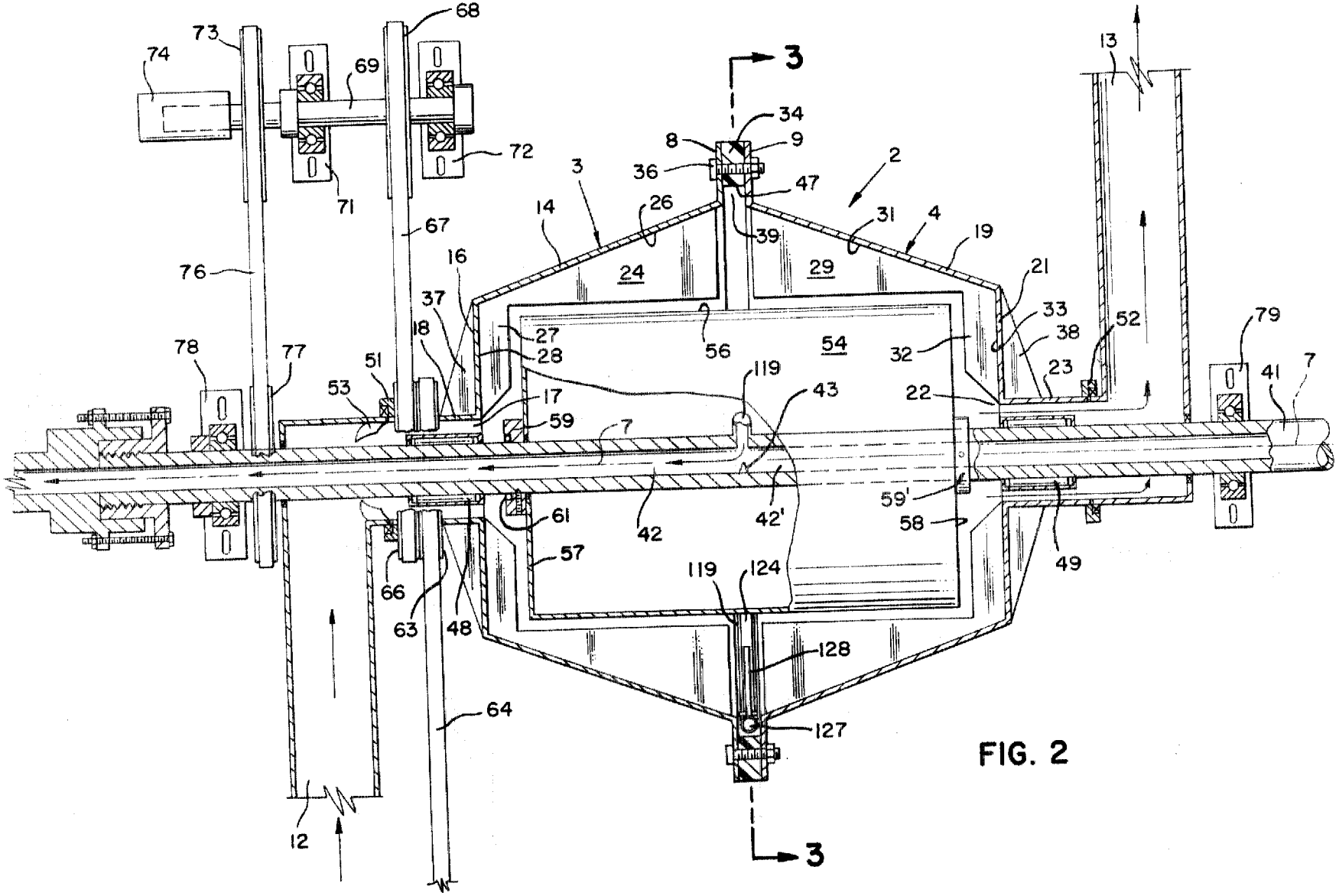
FIG. 2 is a plan view of the apparatus shown mounted for rotation about a horizontal axis and with parts of the structure broken away to reveal underlying structure.

In terms of greater detail, the centrifuge apparatus for separating solids from industrial waste water and forming the subject matter of this invention comprises, in the embodiment illustrated in FIGS. 1 and 2, a two-part outer housing assembly designated generally by the numeral 2, and including an input shell designated generally by the numeral 3, and an output shell designated generally by the numeral 4, the input shell 3 being hollow and configured in the form of a truncated cone arranged symmetrical about a longitudinal axis designated generally by the numeral 7, which in FIGS. 1 and 2 is illustrated as being in a horizontal attitude. The truncated shells 3 and 4 possess hollow interiors, and each is provided with a radially outwardly extending flange designated as 8 for the truncated shell 3, and designated as 9 for the truncated shell 4. The interior of the inlet shell 3 is connected by an inlet passageway 12, while the shell 4 is connected by an outlet passageway 13.

The truncated conical shell 3 includes conical side wall 14, and end wall 16 centrally apertured to provide an opening 17 communicating with the interior of the truncated conical shell, the opening 17 communicating with the interior of a conduit 18 that connects with the inlet passageway 12.

In like manner, the truncated conical shell 4 includes a conical wall 19 converging toward end wall 21 having a central aperture 22 communicating with the interior of a conduit 23 that connects with the outlet passageway 13. The shell 3 is provided with a plurality of baffles 24 that are plate-like in their configuration and which are attached by their edges to the inner periphery 26 of the shell, and each of which includes an extension 27 fixed by its edge to the inner peripheral surface 28 of the end wall 16.

In like manner, the truncated conical shell 4 is provided interiorly with a plurality of baffles 29 similarly secured to the inner peripheral surface 31 of the shell, with each of the baffles extending in a portion 32 that is similarly secured, as by welding for instance, to the inner peripheral surface 33 of the end wall 21. As illustrated in FIG. 2, the inner edges of the baffles 24, 27, and 29, 32 cooperate to define a space within the assembled shells 3 and 4 that is generally cylindrical in its configuration. As also illustrated in FIG. 2, the base flanges 8 and 9 of the shells 3 and 4 sealingly abut a seal member 34 disposed therebetween which is held in a water-tight fashion by appropriate bolts 36 extending through the base flanges 8 and 9 and the sealant material 34 in the manner illustrated in FIGS. 1 and 2 in sufficient numbers to ensure a water tight union between the two base flanges 8 and 9.

From this construction it will be seen that the side walls 14 and 19 of the shells 3 and 4, respectively, are significantly reinforced by the radially inwardly projecting baffles 24 and 29, respectively, while the end plates 16 and 21 are also significantly reinforced by the axially extending flanges or baffles 27 and 32, respectively. To further reinforce the union between end plates 16 and 21 and the associated conduits 18 and 23, respectively, gusset plates 37 and 38 are appropriately welded between the end plates and the associated conduits in the manner illustrated.

Collection means are provided within the housing 2 in a zone intermediate the ends thereof and constitutes an annular chamber 39 defined by the root sections of the base flanges 8 and 9 and the inner periphery of the seal member 34. Thus, the chamber 39 forms the outermost extremity of the interior surface of the hollow housing 2 and forms the zone or chamber into which solids separated from the industrial waste water will collect, as will hereinafter be explained.

To rotatably support the housing assembly 2, there is provided for rotation about a horizontal axis an elongated hollow shaft 41 having an interior bore 42 extending the entire length of the shaft 41 and having positioned in the bore 42 a splitter plate 43, which is positioned with its edge lying in a median plane centrally disposed between the base flanges 8 and 9 and generally in the plane indicated by the line 3—3 in FIG. 2. Suitably welded or otherwise secured to the shaft 41 in the same plane containing the splitter plate, and communicating with the interior bore 42 diametrically opposite from the splitter plate 43, is a pick-up tube 119 that extends radially outwardly and circumferentially from the shaft 41 and which lies disposed between the opposed edges of the baffle plates 24 and 29 as shown.

The pick-up tube 119 preferably is circular in its cross-section and is provided at its extreme outer end with a chisel point 121, the outer extreme end of which rides very closely to the inner periphery 47 of the seal 34 within the collection chamber 39. Additionally, the pick-up tube 119 is preferably arcuate in its configuration, turning in the direction in which it is to be rotated, so that upon rotation, the open chisel point 121 of the pick-up tube rides in the collection zone or chamber 39 and scoops up whatever solids have collected there, the ram-jet effect of rotation of the pick-up tube 119 in relation to the outer housing assembly 2, causing the solids that have collected in the chamber 39 to be transported through the collection tube 119 and to be deposited in the interior bore of the shaft 41.

It is at this point that the splitter plate 43 comes into play, splitting the stream of high content solid and liquidous material into two different streams, one passing to the left and exiting through the central bore 42 of the shaft 41, while another stream passes to the right and exits through the central bore 42' of the shaft 41. Thus, the placement of the splitter increases the volumetric capacity that the apparatus can handle by providing twice the cross-sectional area through which solids may flow.

As illustrated in FIGS. 1 and 2, the outer housing assembly 2 is journaled on the shaft 41 by means of appropriate bearings 48 and 49 disposed between the outer periphery of the shaft 41 and the inner periphery of the conduit portions 18 and 23 at opposite ends of the assembled shell structure or housing 2. It should be noted that the conduit portions 18 and 23 rotate with the outer housing 2 while the inlet passageways 12 and 13 are stationary yet have their interior bores communicating with the interior passageways of the conduits 18 and 23 so as to admit industrial waste water into the interior of the housing tube. To accommodate such relative rotation between the fixed inlet and outlet passageways 12 and 13 and the conduits 18 and 23, there is provided adequate slip joints 51 and 52 between these parts so that one may rotate while the other remains stationary while functioning to seal the union therebetween so as to prevent the leakage of industrial waste water through this slip joint. Conventional slip joints of this type are readily available commercially and the specific structure thereof will not be described in detail in the interest of brevity.

Since all of the industrial waste water that is admitted to the housing tube must pass through the inlet passageway 12 and thus through the bearing assembly 48, it is noted that the bearing assembly 48 is a spider-type bearing assembly that provides considerable space or openings between the inner and outer races while providing a rigid attachment therebetween so that water may flow easily through the spaces between the inner and outer races. However, since any such structure causes an impediment to the passage of water, there is provided on the interior surface of the rotating conduit portion 18, a plurality of impeller blades 53 that rotate with the conduit 18 and which serve to impel the industrial waste water admitted to the housing in the proper direction, i.e., the impeller blades 53 impose a certain amount of pressure on the water to force it through the spider bearing assembly 48.

Since the baffle assembly 24, 27, 29 and 32 define within their inner edges a generally cylindrical configuration within the outer housing 2, and since it is not in the best interest of the efficient operation of the apparatus that this entire volume be filled with industrial waste water, there is provided within the confines of the outer housing, an inner housing or shell designated generally by the numeral 54 and including a cylindrical wall 56 that is symmetrical about the longitudinal axis of the shaft 41 and proportioned so that the cylindrical surface 56 lies spaced a short distance, say approximately one inch, from the inner edges of the baffle plates 24 and 29. At each end, the shell 54 is provided with end plates 57 and 58, the end plate 57 being spaced a short distance from the baffles 27, while the end plate 58 is spaced a short distance from the baffles 32.

The drum 54 is fixed for rotation on the shaft 41 by collars 59 and 59' that are appropriately secured to the shaft 41 by set screws. Additionally, the collars 59 and 59' provide seal means 61 for preventing the entrance of water into the hollow housing or shell 54. Additionally, it should be noted that the pick-up tube 119 passes through the interior of the hollow shell 54 and passes through an appropriate aperture 62 in the cylindrical wall 56. The union of the pick-up tube 119 and the cylindrical wall 56 is sealed to prevent water from passing into the interior of the hollow shell 54.

It will thus be seen that the interior of the assembled housing 2 is converted by the baffle assembly and the inner shell or housing 54 into a generally peripheral passageway that forces the industrial waste water in the interior of the housing to be initially guided toward the outer periphery of the housing. This tendency of the water to flow outwardly toward the outer periphery is enhanced by rotation of the outer housing and by the inner housing and such rotation is effected as indicated above either by an internal combustion engine appropriately connected to the outer housing and to the shaft 41, or by an electric motor so connected. For this purpose, a two-stage pulley assembly is fixedly mounted on the rotatable conduit portion 18, the main drive pulley 63 being driven by a belt 64 from an appropriately geared internal combustion engine or electric motor (not shown) and effective to drive the pulley 66 associated therewith which, through a belt 67, drives a pulley 68 mounted on a mandrel 69 which is in turn journaled on appropriate bearings 71 and 72.

Also mounted on the mandrel 69 is a pulley 73 associated with a variable drive mechanism 74 that controls the rotational speed of the belt 76 and the drive pulley 77 to which it is connected and which is fixedly mounted on the shaft 41 to effect rotation thereof. The variable drive assembly 73–74 effects a variable rotational speed by increasing or decreasing the effective diameter of the drive pulley 73. These types of devices are commercially available and are thereof not explained in detail herein in the interest of brevity in this description.

Obviously, the entire assembly is supported on the shaft 41 through appropriate bearings 78 and 79 mounted on any type of suitable support which is preferably some type of concrete pedestal appropriately arranged adjacent opposite ends of the shaft 41 so as to underlie the bearings 78 and 79.

Thus, in the embodiment illustrated in FIGS. 1 and 2, industrial waste water laden with solids is admitted through the passageway 12, encounters the impellers 53 and is impelled under pressure through the spider bearing assembly 48 and into the interior of the housing assembly 2, where it spreads radially outwardly, is caught and channelled by the baffles 27, thus being directed radially outwardly toward the outer periphery of the inner shell 54 where the waste water continues to flow between the baffles 24 toward the collection channel 39.

Since the outer housing 2 is rotating, the heavier particles of greater density are forced radially outwardly against the inner surface 26 of the shell 3 and migrate longitudinally toward the collection chamber 39 where, because of the relative velocities of the outer housing and the scoop end 46 of the pick-up tube 119, such particles or "solids" are picked up by the pick-up tube 119 and transported therethrough and through the bores 42 and 42' of the shaft 41. At each opposite end of the shaft 41 the solid materials are collected in a manner which is not shown, but which can be a gondola truck, for instance, which is arranged to permit whatever residual water remains in the solids to drain off and permits the solid material to collect in the gondola car for transport to an appropriate dumping area. In some instances, depending upon what the content of the solids is, such solid waste material may be used for fertilizer either by dumping it directly on the land, or by processing it to some further extent and mixing it with other ingredients.

Figure 4:
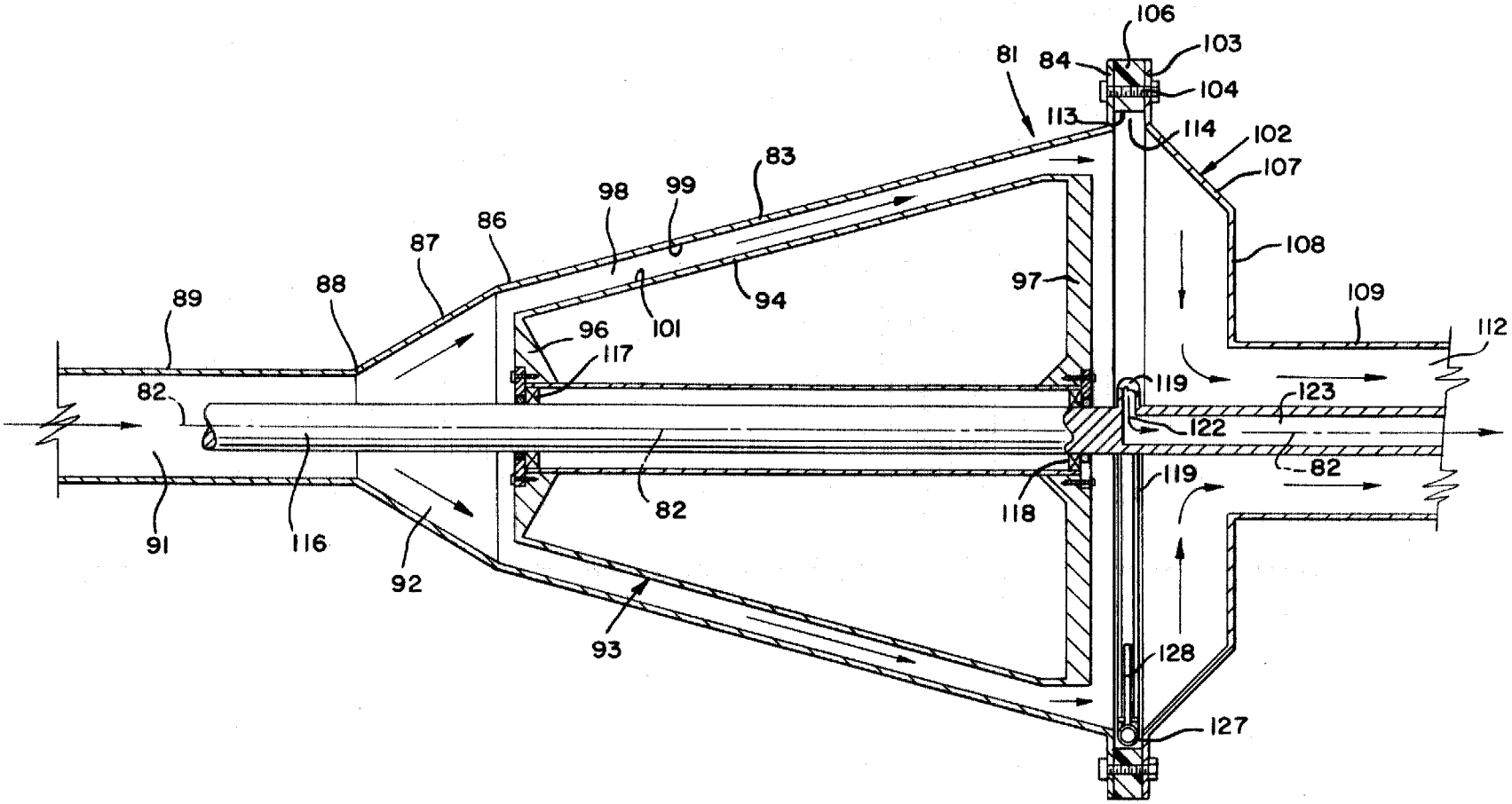
FIG. 4 is a horizontal sectional view of a second embodiment of the invention, shown mounted for rotation about a horizontal axis.

In the embodiment of the invention illustrated in FIG. 4, the same principle of centrifugal force is utilized to effect a separation of the higher density materials from lower density materials and from the water in which such higher density materials are entrained. Structurally, the embodiment of the invention illustrated in FIG. 4, comprises a housing assembly designated generally by the numeral 81, and is generally symmetrical about a longitudinal axis 82, and is formed from a conical shell 83, truncated in its configuration to provide a base flange 84 and an apex end portion 86 that is connected integrally with an auxiliary truncated conical shell 87, the apex end 88 of which is connected to an inlet conduit 89 the interior passageway 91 of which is connected with the interior 92 of the truncated conical shell 87, which interior is in turn connected with the interior of the truncated conical shell 83.

Since it is undesirable that the entire volume of the interior of the truncated conical shell 83 be filled with industrial waste water laden with entrained solids, and since it is more efficient that such industrial waste water be channelled near the outer periphery of the truncated conical shell 83, there is provided on the interior of such truncated conical shell 83, an inner housing or shell 93 also having a truncated conical outer wall 94 spaced radially inwardly from the conical shell 83 and provided with end walls 96 and 97 as shown. In this embodiment, the outer housing 81, and specifically the truncated conical shell portion 83 thereof, is mechanically interconnected with the inner housing 93, and specifically the truncated conical shell wall 94, by longitudinally extending baffle plates 98 that are welded or otherwise secured along their outer edges to the inner peripheral surface 99 of the truncated conical shell wall 83, and welded or secured in like manner to the outer surface 101 of the truncated conical shell 94 so that the two shells are integrally connected so that when one revolves the other revolves with it. The baffle plates 98 disposed between the two shells are conveniently at least six in number, however an additional number or fewer number might be provided.

The base flange 84 of the housing assembly 81 is sealingly connected on the discharge side of the housing to a shell structure 102 having a base flange 103 connected by appropriate bolts 104 and an annular seal member 106 to the base flange 84. The shell housing 102 is provided with a sharply conical wall portion 107 that merges with a flat wall portion 108 which in turn merges with an outlet chamber or passageway 109 symmetrically disposed about the longitudinal axis 82 and which provides an outlet passageway 112 to discharge industrial waste water from which the solid entrained matter has been removed.

As with the embodiment illustrated in FIGS. 1 and 2, the inner peripheral surface 113 of the seal ring 106 is proportioned to define an annular chamber 114 between the base flanges 84 and 103 as illustrated, to constitute a collection means between the two conical shells 81 and 102 for the collection of entrained solids from the industrial waste water stream passing therethrough. As with the embodiment illustrated in FIGS. 1 and 2, note that the inlet passageway 91 feeds into a relatively larger volume within the interior 92 of shell 87, which in turn feeds into the openings defined between the baffles 98 at the apex end of the outer shell 83 and the apex end of the inner housing shell 94. It should be noted that the cross sectional area of these openings increase progressively as the diameter of the conical shell increases, thus increasing the volumetric capacity of the longitudinal passages defined by the baffle 98. Thus, as the volumetric capacity increases, the longitudinal velocity of the industrial waste water passing the housing diminishes while the rotational velocity increases because of the larger diameter. The suspended solid matter carried by the stream of industrial waste water is thus subjected to high centrifugal forces that tend to effect collection of such solid materials adjacent the inner peripheral surface 99 of the outer housing. At the same time, the force of the water passing therethrough causes such material to migrate longitudinally and ultimately be deposited in the collection chamber 114.

To effect rotation of the housing assembly 81, including the shell 102, the entire housing assembly is mounted on a central shaft 116, with the inner housing assembly 93, through the end walls 96 and 97, being rotatably mounted on the shaft 106 through appropriate seal and thrust bearing assemblies 117 and 118 arranged adjacent opposite ends of the inner housing assembly. Thus, the housing assembly, including the outer housing 81 and the inner housing 93 which is connected to it by virtue of the interconnecting baffles 98, may be rotated at one speed in a manner previously described, while the shaft 116 is rotated at a different rotational speed or not at all as might be selected by the operator.

To effectively pick up the solid material that is deposited in the collection chamber 114, the shaft 116 at its end adjacent the discharge end shell 102, is provided with a radially outwardly projecting pick-up tube 119 the outer end of which is provided with a chisel point 121 adapted to plow through the solid material gathered in the collection chamber 114 and through the ram-jet effect thus produced, cause such solid material, which of course has a small amount of water mixed therewith, to be transported through the pick-up tube 119, from which it is deposited through an appropriate opening 122 into the interior bore 123 of the shaft 116. From the bore 123, the solid waste material is discharged into an appropriate catch basin or collected in some other manner (not shown) for disposition in whatever way may be economically feasible.

Figure 3:
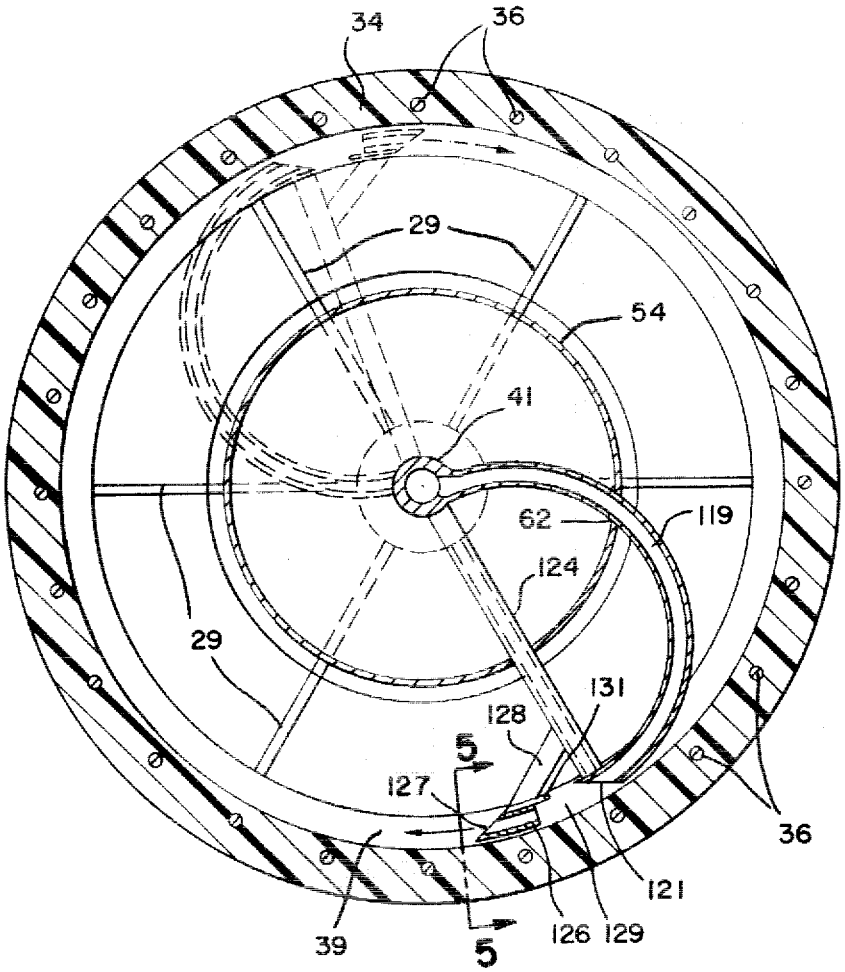
FIG. 3 is a vertical cross-sectional view taken in the plane indicated by the line 3—3 in FIG. 2.
Figure 5:
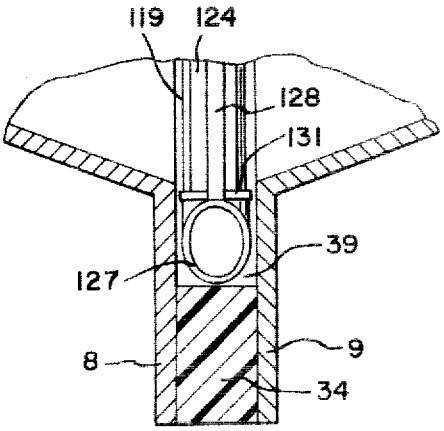
FIG. 5 is a fragmentary sectional view taken in the plane indicated by the line 5—5 in FIG. 3.

Referring to FIGS. 3 and 5, it will be seen that the pick-up tube 119 in the embodiment of FIG. 4, is provided with an arcuate configuration so that the chisel point 121 of the pick-up tube points in the direction in which the tube rotates with the shaft 116. Additionally, because high centrifugal forces might tend to straighten the tube 119, thus disrupting the clearance that must exist between the chisel point 121 of the pick-up tube and the inner peripheral surface 113 of the collection chamber 114, there is provided a radially extending brace 124 connecting the outermost end of the pick-up tube with the shaft 116, thus functioning to withstand any centrifugal force stresses that might be imposed on the pick-up tube.

Additionally, it has been found that high centrifugal force tends to pack the solids entrained within the industrial waste water stream into the chamber 114. It has been found that occassionally, such solid materials may be packed in the chamber with such compactness that it is difficult for the ram-jet effect of rotation of the pick-up tube to pick up such compacted material. Accordingly, as illustrated in FIGS. 3 and 5, there is provided in advance of the chisel point 121 of the pick-up tube, a generally tubular assembly 126 having a chisel point 127 displaced 180° from the chisel point 121 of the pick-up tube, and being suspended on a brace or gusset 128 as shown.

Also as shown, the chisel assembly 126–128 is positioned ahead of the pick-up tube chisel point 121 to provide a small space 129 therebetween to facilitate mixture of the solid material with an appropriate amount of water in the collection chamber 114 to enhance flow of such solid material through the pick-up tube and through the interior of the shaft 116. Preferably, the plow-like chisel point 126–128 is somewhat larger than the chisel point 121 and is proportioned and configured to literally plow through the compacted material in the collection chamber 114, loosen it, cause it to mix with an appropriate amount of water, so that it may be picked up by the following chisel point 121. Additionally, it has been found that a baffle plate 131 may be positioned above the tubular plow-like assembly 126 so as to confine in the collection chamber the solid material that is plowed up until it is picked up by the following chisel point 121 on the pick-up tube 119.

While this construction of the pick-up tube 119 has been described in connection with FIG. 4, it is obvious that this same configuration of pick-up tube may be used in the embodiment of the apparatus illustrated in FIGS. 1 and 2.

Figure 6:
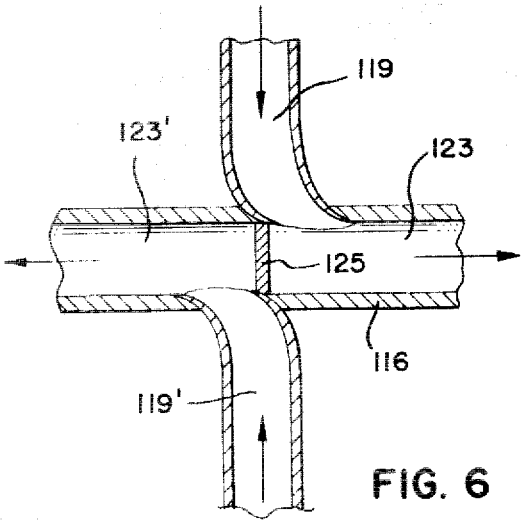
FIG. 6 is a fragmentary sectional view showing another embodiment for extracting solids from the apparatus.

In the embodiment of FIGS. 1 and 2, the pick-up tube 44 has been described as associated with a splitter 43 which functions to split the stream of solid material transported through the pick-up tube 119 and into the interior bores 42 and 41'' so as to cause the solid material to flow in opposite directions out of the central shaft 41. Where entrained solids constitute a high proportion of the stream of industrial waste water, it may be desirable to provide two pick-up tubes positioned in diametrically opposed relationship as indicated in broken lines in FIG. 3. In such an assembly, in order that the discharge of the solid waste materials from the pick-up tube 119 into the central bore 123 of the discharge shaft not oppose the discharge from the opposite pick-up tube, the arrangement illustrated in FIG. 6 may be utilized where one pick-up tube 119 discharges into the interior bore 123 of the central shaft 116 in the manner previously discussed, while the second pick-up tube 119' also discharges into the interior of the shaft 116, with the discharges being offset and the interior bore 123 being divided to provide a second interior bore 123' that is separated from the interior bore 123 by a baffle plate 124 positioned in the interior bore as illustrated. In this way, in order to handle particularly heavy proportions of solid-to-liquidous material, the discharge paths of the two pick-up tubes do not work against each other and solid material may be discharged from opposite ends of the central shaft 116.

Having thus described the invention, what is considered to be patentable and sought to be protected by Letters Patent of the United States is as follows:

I claim:

1. In a centrifuge apparatus for separating entrained solids from industrial waste water, the combination comprising:

(a) a housing assembly rotatable about a central axis and having inlet and outlet passageways for the admission of industrial waste water containing a high proportion of entrained solids and for the discharge of such industrial waste water after a large proportion of the solids have been removed therefrom, said housing assembly including rotatable inner and rotatable outer housing shells defining therebetween a passageway for said industrial waste water between said inlet and outlet passageways;

(b) a collection chamber for collecting said solids within said housing assembly;

(c) rotatable shaft means on which said housing assembly is rotatably mounted, at least one portion of said shaft means having a central bore therethrough for the discharge of solid material extracted from said industrial waste water stream; and (d) dredge means mounted within said housing assembly on said rotatable shaft means and movable through said collection chamber for picking up segregated solids extracted from said industrial waste water stream and transporting said solids to the exterior of said housing through said hollow shaft means.

2. The combination according to claim 1, in which plow means are provided mounted ahead of said dredge means and movable therewith through said collection chamber and effective to stir up the solids collected in said collection chamber prior to their being dredged therefrom and removed from the housing assembly.

3. The combination according to claim 1, in which said housing assembly is symmetrical about said central axis and is symmetrical in relation to a transverse plane perpendicular to the central axis.

4. The combination according to claim 1, in which said housing assembly includes outer and inner housing members defining a passageway therebetween for industrial waste water, said outer housing comprising a two-part hollow shell including a pair of truncated conical shells sealingly attached at their major bases and said inner housing member comprises a cylindrical shell symmetrical about the central axis and coaxially arranged within the outer housing.

5. The combination according to claim 1, in which said housing assembly includes outer and inner housing members, and baffle means are provided disposed between the outer and inner housings to define circumferentially spaced and longitudinally extending passageways between the inner and outer housing for said stream of industrial waste water.

6. The combination according to claim 1, in which said outer housing assembly includes a pair of truncated conical shells sealingly attached at their major bases, and said collection chamber is disposed between said truncated conical shells.

7. The combination according to claim 1, in which said shaft means is rotatable about a longitudinal axis for rotatably supporting said housing assembly, said shaft including a centrally disposed longitudinally extending passageway for the discharge of solids from the interior of said housing assembly, said dredge comprising a generally arcuate tubular member connected at its inner end to the shaft intermediate its ends, the hollow interior of said tubular dredge communicating with the longitudinal bore of the shaft, the opposite end of the tubular dredge member movable by rotation of the shaft through said collection chamber for transporting solid material from said collection chamber through said hollow tubular dredge and the hollow interior of said shaft to the exterior of said housing assembly.

8. The combination according to claim 1, in which said housing assembly comprises outer and inner housing members including truncated conical shell walls spaced apart to provide a channel therebetween for said industrial waste water containing a high proportion of solids, said housing assembly including a series of circumferentially spaced baffles disposed between the inner and outer truncated conical shell to define longitudinally extending passageways for said industrial waste water, said longitudinally extending passageways communicating at the large base end of said truncated conical shells with said collection chamber, and means for effecting movement of said dredge means through said collection chamber at a rotational speed different than the rotational speed of said housing assembly to effectively dredge up the solid material separated from the stream of industrial waste water and deposit said solid material outside the housing assembly.

9. The combination according to claim 1, in which said housing assembly includes outer and inner housings, each being independently rotatable at selectively controlled rotational speeds, said collection chamber being rotatable at the speed of said outer housing, and said dredge means being rotatable at the speed of said inner housing.

10. The combination according to claim 1, in which means are provided for effecting rotation of said outer housing shell at one speed while said shaft means and said inner shell are rotated at another speed.

11. The combination according to claim 1, in which said housing assembly includes inner and outer housings mounted for independent rotation, said outer housing being rotatable at a first rotational speed, said inner housing and said shaft being rotatable at a second rotational speed, and means interposed between said outer housing and said shaft and inner housing for controlling the relative speed of rotation thereof.

12. The combination according to claim 1, in which a pair of tubular dredges are provided on opposite sides of the central axis at diametrically opposed positions, each such tubular dredge connected at its inner end to said shaft and having its interior communicating with the longitudinal bore in said shaft, while the outer end of each dredge extends into said collection chamber for movement therethrough to pick up solid material deposited therein.

13. The combination according to claim 1, in which said elongated shaft means is hollow for its entire length, said tubular dredge is mounted on said shaft at a point intermediate the ends thereof, the interior of said tubular dredge communicating with the interior of said hollow shaft, the end of said tubular dredge remote from said shaft extending into said collection chamber and movable therethrough to pick up solid material deposited therein and transport such solid matter to the interior of said hollow shaft, and means within said shaft positioned where said solid material is discharged into said hollow shaft to effect splitting of the stream thereof so that one part of the stream of solid material is discharged in the opposite direction through said hollow shaft.

14. The combination according to claim 1, in which said housing assembly includes an inner housing shell and an outer housing shell, said outer housing shell comprising a relatively elongated truncated conical portion having a base flange, a relatively shorter housing shell including a discharge conduit portion, an annular waste water passageway portion and a truncated conical portion merging with a radially extending base flange portion, said base flange portion being axially spaced from the base flange of said truncated conical housing portion, seal means interposed between said base flanges and proportioned to cooperate with said base flanges to form a collection chamber therebetween, said collection chamber being annular in its configuration, baffle means fixedly interposed between the truncated conical portion of said outer housing and the truncated portion of said inner housing and spaced circumferentially thereabout to form a plurality of longitudinally extending passageways for the passage of waste water therethrough, said inlet into the housing communicating with the apex end of said truncated housing shells whereby said waste water enters the housing at relatively high velocity, enters said passageways defined by said multiplicity of baffles and has imparted to it a rotational moment and a diminution in its velocity in a longitudinal direction, said multiplicity of passageways between the inner and outer truncated shells communicating with said collection chamber whereby solids entrained in said stream of industrial waste water are forced by centrifugal force to collect in said collection chamber from whence they are dredged by said tubular dredge means.

15. The combination according to claim 1, in which said shaft means includes a central passageway extending longitudinally therethrough, a transverse wall within said longitudinal passageway dividing said passageway into a left portion and a right portion, a pair of said dredge means disposed on opposite sides of the central axis of said shaft means, the inner end of one of said tubular dredge means being connected with said shaft, the interior thereof communicating with the longitudinal passageway on the left side of said transverse wall, the second tubular dredge of the pair having its inner end connected to the shaft with the interior of said tubular dredge communicating with the interior of the shaft to the right of said transverse wall whereby solid material dredged up by one of said tubular dredges is transported and discharged from the apparatus at one end while solid material dredged up by the other tubular dredge is transported and discharged from the apparatus at the opposite end thereof.

16. The combination according to claim 15, in which plow means are mounted ahead of each of the tubular dredge means for stirring up the solid material in said collection chamber prior to its being picked up by said dredge means.

* * * * *